US011946482B2

(12) United States Patent
Yokozuka et al.

(10) Patent No.: US 11,946,482 B2
(45) Date of Patent: Apr. 2, 2024

(54) VACUUM PUMP, ROTOR, AND WASHER

(71) Applicant: Edwards Japan Limited, Yachiyo (JP)

(72) Inventors: Katsuhisa Yokozuka, Yachiyo (JP); Yoshinobu Ohtachi, Yachiyo (JP); Yasushi Maejima, Yachiyo (JP); Tsutomu Takaada, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 160 days.

(21) Appl. No.: 17/625,165

(22) PCT Filed: Jul. 3, 2020

(86) PCT No.: PCT/JP2020/026285

§ 371 (c)(1),
(2) Date: Jan. 6, 2022

(87) PCT Pub. No.: WO2021/010196

PCT Pub. Date: Jan. 21, 2021

(65) Prior Publication Data

US 2022/0268289 A1 Aug. 25, 2022

(30) Foreign Application Priority Data

Jul. 12, 2019 (JP) ..... 2019-130636

(51) Int. Cl.
*F04D 29/04* (2006.01)
*F04D 19/04* (2006.01)
*F04D 29/048* (2006.01)

(52) U.S. Cl.
CPC ..... *F04D 29/048* (2013.01); *F04D 19/042* (2013.01)

(58) Field of Classification Search
CPC .... F04D 29/048; F04D 29/266; F04D 29/662; F04D 29/668; F04D 29/058; F04D 29/32;
(Continued)

(56) References Cited

U.S. PATENT DOCUMENTS 5,354,172 A 10/1994 Schofield
5,686,772 A * 11/1997 Delamare ..... F16C 32/0408 310/90

(Continued)

FOREIGN PATENT DOCUMENTS

CN 103958608 A 7/2014
CN 106243952 A 12/2016

(Continued)

OTHER PUBLICATIONS

Machine Translation JP 4-934089 (Year: 2023).*

(Continued)

*Primary Examiner* — Mark A Laurenzi
*Assistant Examiner* — Dapinder Singh
(74) *Attorney, Agent, or Firm* — Shumaker & Sieffert, P.A.

(57) ABSTRACT

A vacuum pump and a washer which can reduce vibration of a rotor and the rotor which can reduce the vibration are provided. When an inertia moment ratio which is a ratio between the inertia moment around a z-axis and the inertia moment around an x-axis or a y-axis is larger than 1, a natural frequency $\omega_2$ does not match a rotational frequency $\Omega_z$ but goes away from that. When the natural frequency $\omega_2$ matches the rotational frequency $\Omega_z$, the rotor vibrates and thus, a fatigue failure occurs in a rotor blade. When the rotor is to be made larger in a radial direction of a rotating shaft, a value of the inertia moment ratio is set to a value larger than 1.

8 Claims, 8 Drawing Sheets

(58) Field of Classification Search
CPC .... F04D 29/321; F04D 29/522; F04D 19/042; F04D 19/002; F04D 25/0606; F04D 25/08; F04D 25/06
See application file for complete search history.

(56) References Cited

U.S. PATENT DOCUMENTS

| | | | | |
|---|---|---|---|---|
| 5,894,181 | A * | 4/1999 | Imlach | F16C 32/0429 310/90.5 |
| 5,911,558 | A * | 6/1999 | Nakazeki | F16C 32/0444 415/118 |
| 5,994,803 | A * | 11/1999 | Jung | F16C 41/008 384/114 |
| 8,172,515 | B2 | 5/2012 | Kawashima et al. | |
| 9,727,026 | B2 * | 8/2017 | Tadla | F16C 32/0414 |
| 10,351,247 | B2 | 7/2019 | Tanaka et al. | |
| 2011/0103934 | A1 | 5/2011 | Ohtachi et al. | |
| 2014/0329968 | A1 | 11/2014 | Masuda et al. | |
| 2016/0178029 | A1 | 6/2016 | Hirano et al. | |

FOREIGN PATENT DOCUMENTS

| | | | |
|---|---|---|---|
| JP | H10252683 | A | 9/1998 |
| JP | 2003244891 | A | 8/2003 |
| JP | 2005083524 | A | 3/2005 |
| JP | 2005105846 | A | 4/2005 |
| JP | 2005180265 | A | 7/2005 |
| JP | 2007170537 | A | 7/2007 |
| JP | 2009185671 | A | 8/2009 |
| JP | 4934089 | B2 | 5/2012 |
| JP | 2012163052 | A | 8/2012 |
| JP | 2016118202 | A | 6/2016 |
| SU | 1036956 | A | 8/1983 |
| WO | 2010095218 | A1 | 8/2010 |
| WO | 2013008519 | A1 | 1/2013 |

OTHER PUBLICATIONS

Machine Translation JP 2005-105846 (Year: 2023).*
Translation and Original International Search Report from counterpart International Application No. PCT/JP2020/026285 dated Sep. 8, 2020, 9 pp.
Extended Search Report from counterpart European Application No. 20839823.0, dated Jun. 27, 2023, 8 Pages.
Decision of Rejection, and machine translation thereof, from counterpart Japanese Application No. 2019-130636 dated Oct. 3, 2023, 7 pp.
First Office Action and Search Report, and translation thereof, from counterpart Chinese Application No. 202080046700.8 dated Oct. 23, 2023, 12 pp.
Search Report from counterpart Chinese Application No. 202080046700.8 dated Oct. 26, 2023, 3 pp.

* cited by examiner (A)

(B)

(C)

(A)

(B)

(C)

VACUUM PUMP, ROTOR, AND WASHER

This application is a U.S. national phase application under 35 U.S.C. § 371 of international application number PCT/JP2020/026285 filed on Jul. 3, 2020, which claims the benefit of JP application number 2019-130636 filed on Jul. 12, 2019. The entire contents of each of international application number PCT/JP2020/026285 and JP application number 2019-130636 are incorporated herein by reference.

TECHNICAL FIELD

The present disclosure relates to a vacuum pump, a rotor, and a washer and particularly to a technology for balancing the rotor.

BACKGROUND

In a semiconductor manufacturing device for manufacturing semiconductors, for example, a wafer is placed in a vacuum chamber thereof, and by having a process gas to flow, various membranes are formed on the wafer. In this vacuum chamber, a turbo-molecular pump which is a type of a vacuum pump is fixed via a gate valve, and a dry vacuum pump for keeping an inside of the turbo-molecular pump in a vacuum state to some degree is connected to an outlet port side of this turbo-molecular pump via piping. And on the outlet port side of this dry vacuum pump, a detoxifying device for applying detoxification treatment to the process gas transferred from the vacuum chamber is connected via the piping.

In recent years, due to a reason such as a size increase of a vacuum chamber accompanying the size increase of a wafer and the like, a need for a large-flowrate type turbo-molecular pump capable of exhausting a large amount of the process gas in the vacuum chamber is expected for the semiconductor manufacturing device.

In the turbo-molecular pump, in order to bring the inside of the vacuum chamber into a high vacuum state, the rotor is rotated at a high speed. A rotor blade provided on an outer peripheral surface of the rotor hits molecules of the process gas taken in through the inlet port so that they go toward a downstream side, and the hit molecules further go toward the downstream side while colliding against a stator blade and a rotor blade alternately disposed in an axis direction of a rotating shaft of the rotor, and the process gas is exhausted from the outlet port. It is to be noted that the rotating shaft of the rotor is floated/supported by a magnetic bearing in a radial direction and in an axial direction.

In the turbo-molecular pump, the rotor rotated at the high speed needs to be balanced. For this balancing, in a manufacturing process of the rotor, there are technologies such as removing/working of a part, providing a weight to a part, and mounting a weight to a bolt which fixes the rotor to the rotating shaft as disclosed in Japanese Patent No. 4934089.

SUMMARY

However, imbalance of the rotor is not perfectly modified only by balancing of the rotor in the turbo-molecular pump which is a type of the above-described vacuum pump, and the rotor is slightly unbalanced. Since a center of gravity of this rotor is located at a position shifted from the axis of the rotating shaft, a centrifugal force acts on the center of gravity, and the rotor deflects and vibrates at a rotational frequency of the rotating shaft. Depending on the rotational frequency of the rotating shaft, resonance is induced in the rotor and the rotor deflects largely and thus, it becomes difficult for the magnetic bearing to float/support the rotor, and such a concern is also generated that repeated deflection of the rotor blade and fluctuation in a stress lead to a fatigue failure, which was a problem.

The present disclosure was made in view of the above-described circumstances and has an object to provide a vacuum pump and a washer which can reduce vibration of a rotor and the rotor which can reduce the vibration.

In order to achieve the above-described object, a vacuum pump according to a first aspect of the present disclosure includes:

- a casing having an inlet port and an outlet port;
- a rotor having a rotating shaft;
- a magnetic bearing which rotatably supports the rotating shaft; and
- a motor which rotates/drives the rotating shaft; and
- transfers a gas taken in through the inlet port to the outlet port by rotation of the rotor, in which
- a value of γ expressed in the following expression (1) is larger than 1.

$$\gamma = J_z / J \quad (1)$$

where in the above expression (1), $J_z$ is an inertia moment around an axis of the rotating shaft of the rotor, and J is the inertia moment around an axis orthogonal to the axis of the rotating shaft of the rotor.

In the above-described vacuum pump,

- the rotor has a plurality of rotor blades formed on an outer peripheral surface; and
- the vacuum pump may be a turbo-molecular pump having a plurality of stator blades provided in the casing and disposed alternately with the rotor blades in an axis direction of the rotating shaft.

In the above-described vacuum pump,

- the rotor has a cylinder portion with an axis of the rotating shaft as a center on a downstream side to which the gas is transferred from the rotor blade; and
- the vacuum pump may include a spacer provided in the casing and having a thread groove formed on an inner peripheral surface by opposing the cylinder portion.

In order to achieve the above-described object, a rotor according to a second aspect of the present disclosure is used in a vacuum pump including:

- a casing having an inlet port and an outlet port;
- a magnetic bearing which rotatably supports a rotating shaft; and
- a motor which rotates/drives the rotating shaft;
- is accommodated in the casing and has the rotating shaft; and transfers a gas taken in through the inlet port to the outlet port by rotation, in which a value of γ expressed in the following expression (1) is larger than 1.

$$\gamma = J_z / J \quad (1)$$

where in the above expression (1), $J_z$ is an inertia moment around an axis of the rotating shaft of the rotor, and J is the inertia moment around an axis orthogonal to the axis of the rotating shaft of the rotor.

In order to achieve the above-described object, a vacuum pump according to a third aspect of the present disclosure includes:

- a casing having an inlet port and an outlet port;
- a rotor having a rotating shaft and a disc-shaped washer with an axis of the rotating shaft as a center;

a magnetic bearing which rotatably supports the rotating shaft; and a motor which rotates/drives the rotating shaft, and transfers a gas taken in through the inlet port to the outlet port by rotation of the rotor, in which a value of γ expressed in the following expression (1) can be adjusted by adjusting a thickness of the washer.

$$\gamma = J_z/J \quad (1)$$

where in the above expression (1), $J_z$ is an inertia moment around an axis of the rotating shaft of the rotor, and J is the inertia moment around an axis orthogonal to the axis of the rotating shaft of the rotor.

In the above-described vacuum pump, with the washer with a predetermined thickness as a reference, deflection of the rotor at steady rotation may be decreased by increasing the thickness of the washer so as to decrease the value of γ expressed in the above-described expression (1) or by decreasing the thickness of the washer so as to increase the value of γ expressed in the above-described expression (1).

In the above-described vacuum pump, the deflection of the rotor at the steady rotation may be set smaller than 80 μm.

In the above-described vacuum pump, the thickness of the washer may be adjusted such that the value of γ expressed in the above-described expression (1) is larger than 1.

In order to achieve the above-described object, a rotor according to a fourth aspect of the present disclosure is used in a vacuum pump including:

a casing having an inlet port and an outlet port;

a magnetic bearing which rotatably supports a rotating shaft; and a motor which rotates/drives the rotating shaft;

is accommodated in the casing and has the rotating shaft and a disc-shaped washer with an axis of the rotating shaft as a center; and transfers a gas taken in through the inlet port to the outlet port by rotation, in which a value of γ expressed in the following expression (1) can be adjusted by adjusting a thickness of the washer.

$$\gamma = J_z/J \quad (1)$$

where in the above expression (1), $J_z$ is an inertia moment around an axis of the rotating shaft of the rotor, and J is the inertia moment around an axis orthogonal to the axis of the rotating shaft of the rotor.

In order to achieve the above-described object, a washer according to a fifth aspect of the present disclosure is used in a vacuum pump including a casing having an inlet port and an outlet port, a rotor having a rotating shaft, a magnetic bearing which rotatably supports the rotating shaft, and a motor which rotates/drives the rotating shaft, and transferring a gas taken in through the inlet port to the outlet port by rotation of the rotor;

has a disc shape with an axis of the rotating shaft as a center; and is provided in the rotor, in which a value of γ expressed in the following expression (1) can be adjusted by adjusting a thickness.

$$\gamma = J_z/J \quad (1)$$

where in the above expression (1), $J_z$ is an inertia moment around an axis of the rotating shaft of the rotor, and J is the inertia moment around an axis orthogonal to the axis of the rotating shaft of the rotor.

According to the present disclosure, a vacuum pump and a washer which can reduce vibration of a rotor can be provided. Moreover, according to the present disclosure, a rotor which can reduce the vibration can be provided.

DETAILED DESCRIPTION

Figure 1A:
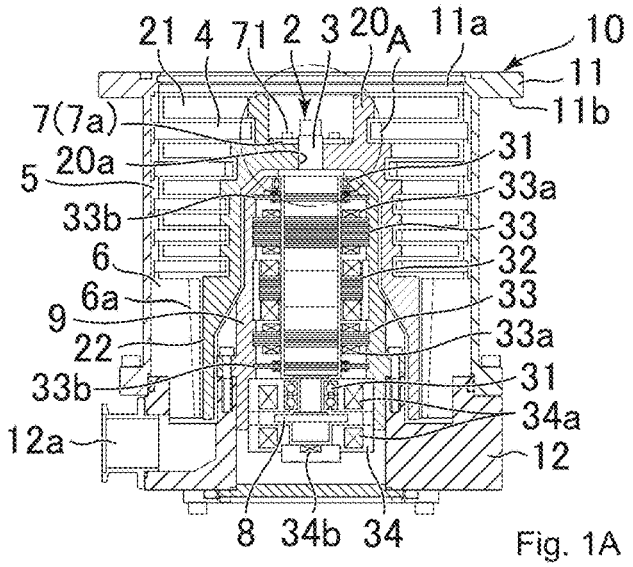
FIG. 1A is a vertical sectional view illustrating a structure of a vacuum pump having a washer with a relatively small thickness according to an example of the present disclosure.
Figure 1B:
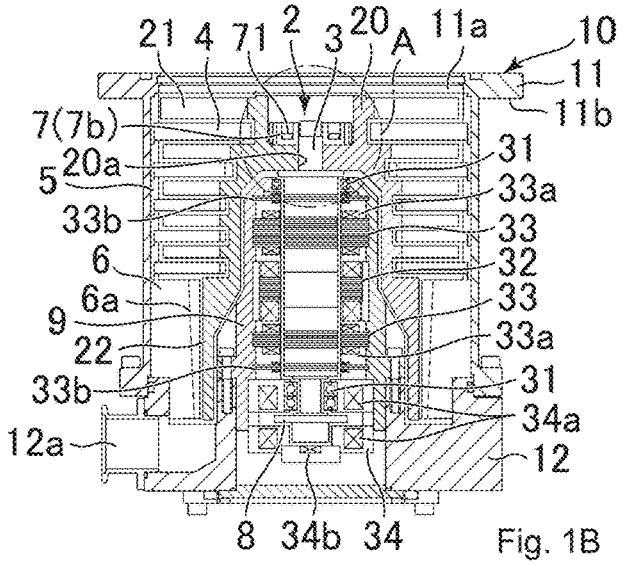
FIG. 1B is a vertical sectional view illustrating a structure of a vacuum pump having a washer with a relatively medium thickness according to an example of the present disclosure.
Figure 1C:
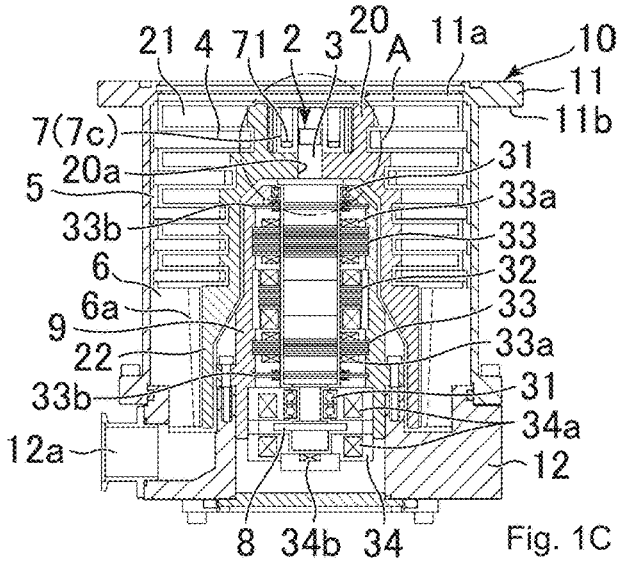
FIG. 1C is a vertical sectional view illustrating a structure of the vacuum pump having a washer with a relatively large thickness according to an example of the present disclosure.

A vacuum pump, a rotor, and a washer according to examples of the present disclosure will be described by referring to the following drawings. A vacuum pump 1 is a turbo-molecular pump and, as shown in FIGS. 1A to 1C, has an outer cylinder portion 11, a base portion 12 to which the outer cylinder portion 11 is fixed, and a rotor 2 rotatably accommodated in a casing 10 constituted by the outer cylinder portion 11 and the base portion 12. An upper side in FIGS. 1A to 1C of the outer cylinder portion 11 is open and constitutes an inlet port 11*a* for a gas (gas), while an outlet port 12*a* for a gas is formed in a side surface on a lower side in FIGS. 1A to 1C of the base portion 12. A flange portion 11*b* is formed on the inlet port 11*a* side of the outer cylinder portion 11, and by fixing this flange portion 11*b* to a vacuum chamber of a semiconductor manufacturing device, for example, the gas in the vacuum chamber can be exhausted via the inlet port 11*a*.

The rotor 2 has a rotor main body 20, a rotating shaft 3, and a washer 7. The rotating shaft 3 is rotatably supported in the casing 10 so as to rotate the rotor 2. On an outer peripheral surface on the upper side in FIGS. 1A to 1C of the rotor main body 20, a plurality of blade-shaped rotor blades 21 inclined at a predetermined angle are integrally formed. The rotor blades 21 are provided radially with respect to an axis of the rotating shaft 3 of the rotor 2 and are provided in multi-stages in an axis direction of the rotating shaft 3 of the rotor 2. Stator blades 4 are provided between the rotor blades 21 at each stage, and the rotor blades 21 and the stator blades 4 are alternately disposed in the axis direction of the rotating shaft 3 of the rotor 2. The stator blades 4 are also formed in plural, each having a blade shape inclined at a predetermined angle. Since an outer peripheral end is sandwiched between a plurality of ring-shaped spacers 5 for stator blade stacked in stages in the outer cylinder portion 11, the stator blades 4 are disposed radially and in multi-stages between the rotor blades 21.

Between the spacer 5 for stator blade disposed on a lowermost stream side and the base portion 12, a threaded spacer 6 is provided. The threaded spacer 6 is formed cylindrically and has a spiral thread groove 6*a* formed on an inner peripheral surface. A cylinder portion 22 with the axis of the rotating shaft 3 as a center is formed on a lower side (downstream side in which the gas is transferred) in FIGS. 1A to 1C of the rotor main body 20, and an outer peripheral surface of the cylinder portion 22 and the inner peripheral surface in which the thread groove 6*a* of the threaded spacer 6 is formed are disposed so as to oppose each other in proximity. A space defined by the outer peripheral surface of the cylinder portion 22 and the thread groove 6*a* of the threaded spacer 6 communicates with the outlet port 12*a*.

Figure 2A:
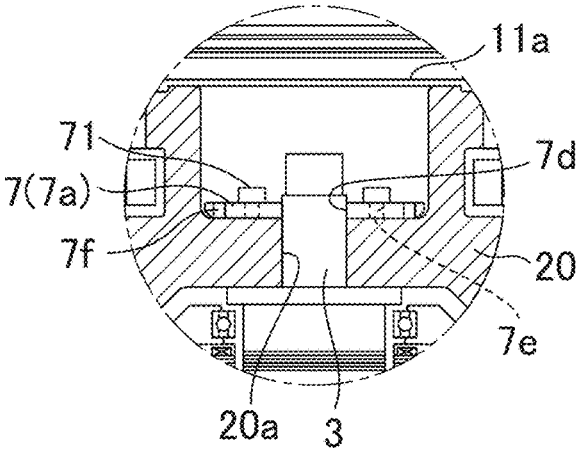
FIG. 2A is an enlarged view of an A part in FIG. 1A.
Figure 2B:
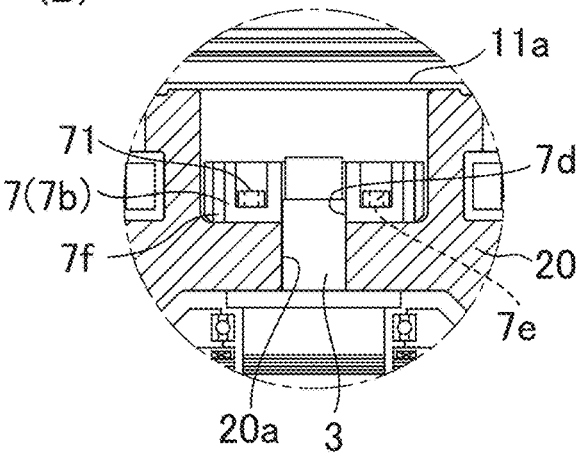
FIG. 2B is an enlarged view of the A part in FIG. 1B.
Figure 2C:
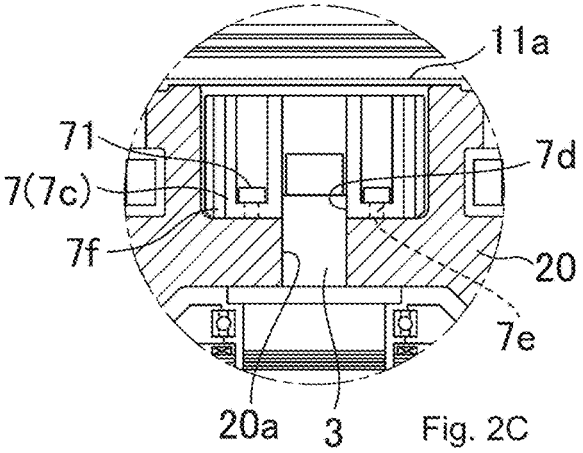
FIG. 2C is an enlarged view of the A part in FIG. 1C.

The washers 7 (7*a*, 7*b*, 7*c*) are formed in a disc state with the axis of the rotating shaft 3 as the center. Each of the washers 7*a*, 7*b*, 7*c* has a thickness different from each other, and as will be described later, reduction of vibration of the rotor 2 by adjusting the thickness of the washer is one of features of the present disclosure. In the washers 7*a*, 7*b*, 7*c*, as shown in FIGS. 2A to 2C, an insertion hole 7*d* for rotating shaft through which the rotating shaft 3 is inserted is formed at a center, and an insertion hole 7*e* for bolt through which a bolt 71 for fixing the rotor main body 20 to the rotating shaft 3 is inserted and an insertion hole 7*f* for screw through which a screw, not shown, for balancing the rotor 2 is inserted are formed radially.

After an upper part in FIGS. 1A to 1C of the rotating shaft 3 is inserted through an insertion hole 20*a* for rotating shaft formed in the rotor main body 20 and the insertion hole 7*d* for rotating shaft formed in the washers 7*a*, 7*b*, 7*c*, the bolt 71 is inserted through the insertion hole 7*e* for bolt and screwed with the rotor main body 20 and the rotating shaft 3 so that the rotor main body 20 is fixed to the rotating shaft 3. At this time, the washers 7*a*, 7*b*, 7*c* are also fixed to the rotating shaft 3 together with the rotor main body 20.

In the vacuum pump 1, when the rotor 2 is rotated at a high speed, the rotor blades 21 hit gas molecules taken in through the inlet port 11*a* so as to cause the gas molecules to go toward the downstream side, and the hit gas molecules collide against the alternately disposed stator blades 4 and go downward and are further hit by the rotor blade 21 on a subsequent stage and go toward the downstream side, and this operation is sequentially repeated up to the rotor blade 21 and the stator blade 4 on lowermost stages, whereby the gas sent to the threaded spacer 6 is sent to the outlet port 12*a* while being guided by the thread groove 6*a*, and the gas is exhausted from the outlet port 12*a*.

In vicinities of an upper side and a lower side (an upstream side and a downstream side where the gas flows) in FIGS. 1A to 1C of the rotating shaft 3, a protective bearing 31 is disposed. The protective bearing 31 prevents the vacuum pump 1 from being broken due to contacting and supporting of the rotating shaft 3 when a radial magnetic bearing 33 and an axial magnetic bearing 34, which will be described later, become uncontrollable at abnormality or the like. A clearance between the protective bearing 31 and the rotating shaft 3 is designed to approximately 50 to 100 μm in total at the minimum in the radial direction.

The rotating shaft 3 is rotated/driven by a direct-current brushless motor 32. The two radial magnetic bearings 33 support the rotating shaft 3 in the radial direction, and the axial magnetic bearing 34 supports the rotating shaft 3 in the axial direction. The two radial magnetic bearings 33 are disposed with the motor 32 between them. The rotating shaft 3 is floated/supported by these radial magnetic bearings 33 and the axial magnetic bearing 34.

Each of the two radial magnetic bearings 33 has four electromagnets 33*a* which cause a magnetic attracting force to act on the rotating shaft 3, and the four electromagnets 33*a* are disposed in two each with the rotating shaft 3 between them on two coordinate axes orthogonal to the axis of the rotating shaft 3 and orthogonal to each other. Moreover, each of the two radial magnetic bearings 33 has four inductance type or eddy-current type positional sensors 33*b* which detect a radial position of the rotating shaft 3. The four positional sensors 33*b* are orthogonal to the axis of the rotating shaft 3 and are disposed in two each with the rotating shaft 3 between them on the two coordinate axes in parallel with the above-described coordinate axis and orthogonal to each other.

On the rotating shaft 3, a disc 8 (hereinafter, referred to as an "armature disc") of a magnetic body with the axis of the rotating shaft 3 as a center is provided. The axial magnetic bearing 34 has two electromagnets 34*a* which cause the magnetic attracting force to act on the armature disc 8. The two electromagnets 34*a* are disposed with the armature disc 8 between them, respectively. Moreover, the axial magnetic bearing 34 has an inductance-type or an eddy-current type positional senor 34*b* which detects an axial position of the rotating shaft 3. It is to be noted that the inductance-type or eddy-current type positional sensor 33*b* of the radial magnetic bearing 33 and the inductance-type or eddy-current type positional sensor 34*b* of the axial magnetic bearing 34 have structures similar to that of the electromagnet and are disposed by having a core around which a conductor coil is wound opposed to the rotating shaft 3.

A stator 9 is stood on the base portion 12 in order to protect the radial magnetic bearing 33, the axial magnetic bearing 34, the motor 32 and the like from the taken-in gas.

Figure 3:
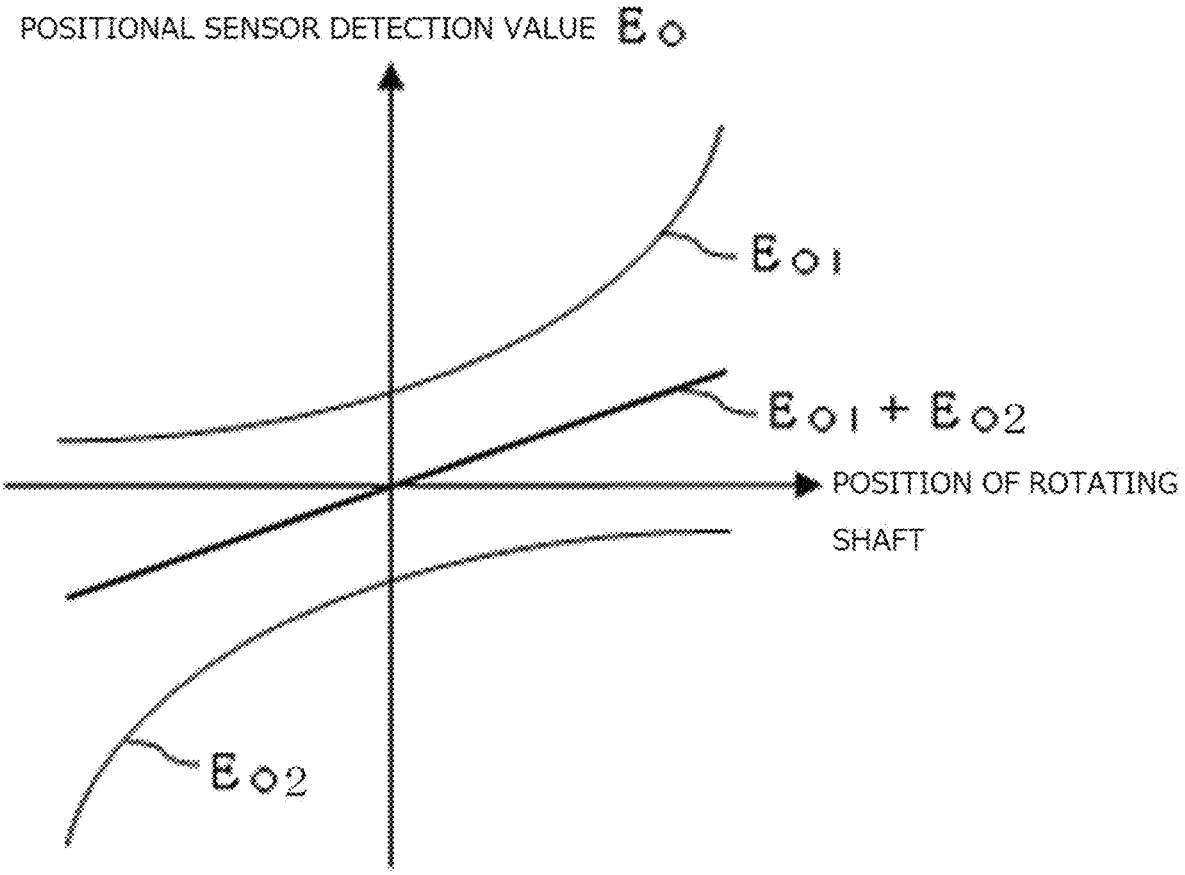
FIG. 3 is a graph illustrating a relationship between a position of a rotating shaft and a positional sensor detection value.

The vacuum pump 1 includes a controller, not shown, which supplies electricity to the radial magnetic bearing 33, the axial magnetic bearing 34, and the motor 32 and sends/receives a signal to/from the positional sensors 33*b* and 34*b* integrally or via a cable. The controller supplies an alternating voltage of a high frequency with a predetermined amplitude to the conductor coils of the positional sensors 33*b* and 34*b* of the radial magnetic bearing 33 and the axial magnetic bearing 34. The conductor coils wound around the cores of the positional sensors 33*b* and 34*b* have their inductances changed in accordance with a distance between the core and the rotating shaft 3, an amplitude of the voltage applied to the conductor coil is changed in accordance with this change in the inductance, and by detecting a changed amplitude value thereof, the controller detects a position of the rotating shaft 3. This amplitude value (positional sensor detection value $E_O$) has, as shown in FIG. 3, non-linearity which is curvedly increased or decreased with respect to the change in the position of the rotating shaft 3. Since a sum $E_{O1}+E_{O2}$ (or a difference depending on how positive/negative signs are defined) of the amplitude values of the two positional sensors 33*b* opposed to each other with the rotating shaft 3 between them on each of the above-described coordinate axes has pseudo-linearity with respect to the change in the position of the rotating shaft 3, the controller calculates the sum (difference), enables application of a linear control theory by using the value as a detection signal of the positional sensor 33*b*, and controls the position of the rotating shaft 3 on the basis of the theory. The controller causes the position of the rotating shaft 3 to match a target position by feedback control which adjusts an electric current value caused to flow through the electromagnet 33*a* on the basis of the sum (difference) of the detection signals of the two positional sensors 33*b* on each of the coordinate axes.

Figure 4:
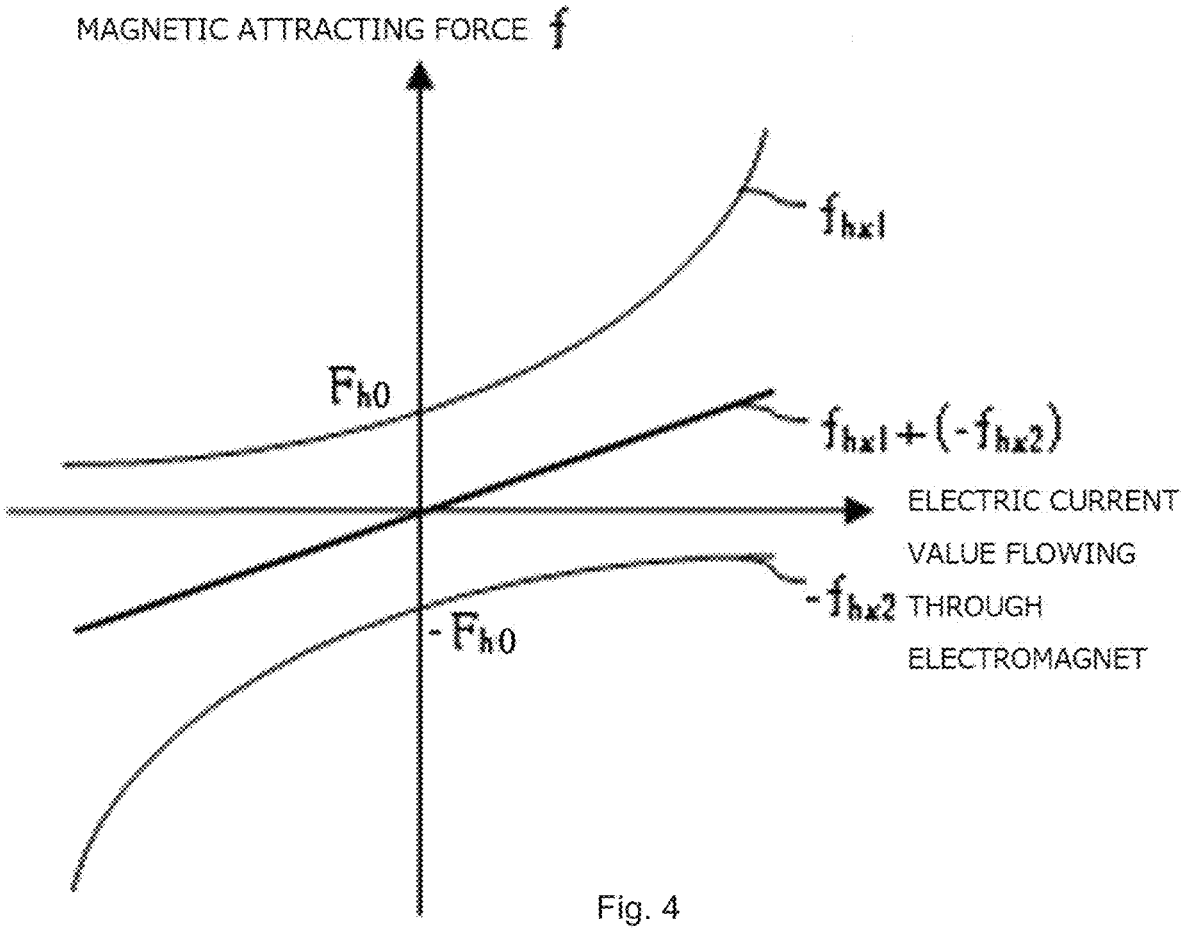
FIG. 4 is a graph illustrating a relationship between an electric current value flowing through an electromagnet and a magnetic attracting force caused by the electromagnet of a magnetic bearing to act on the rotating shaft.

The magnetic attracting force f caused by each of the electromagnets 33*a* of the radial magnetic bearing 33 to act on the rotating shaft 3 also has non-linearity which is curvedly increased or decreased with respect to a change in the electric current flowing through the electromagnets 33*a* as shown in FIG. 4. Thus, regarding the two electromagnets 33*a* opposed with the rotating shaft 3 between them on each of the coordinate axes, the electric current value is adjusted such that an electric current at an electric current value $(I_0+i_1)$ obtained by adding an electric current value $i_1$ to a predetermined direct-current electric current value $I_0$ (hereinafter, referred to as a "bias electric-current value") is caused to flow through the electromagnet 33*a* whose distance from the rotating shaft 3 is larger because the rotating shaft 3 is shifted from the target position, while an electric current at an electric current value $(I_0-i_1)$ obtained by subtracting the electric current value $i_1$ from this bias electric-current value $I_0$ is caused to flow through the electromagnet 33*a* whose distance from the rotating shaft 3 is small. As described above, by setting a sum $f_{hx1}+(-f_{hx2})$ of the magnetic attracting force caused to act by the two electromagnets 33*a* to a magnetic attracting force caused to act on the rotating shaft 3, it is so configured that the magnetic attracting force has pseudo linearity with respect to the change in the electric current value so that the above-described linear control theory can be applied.

A structure of the axial magnetic bearing 34 is basically similar to the structure of the radial magnetic bearing 33, but for the purpose of reduction in a required space or the like, it may be so constituted that, instead of disposition of the two positional sensors with the armature disc 8 between them in the axis direction of the rotating shaft 3, only one unit of the positional sensor 34*b* is disposed, while another positional sensor is substituted by a coil having a predetermined inductance disposed on a circuit board inside the controller. In this case, since the inductance of the coil provided on the circuit board has a predetermined value, while the amplitude value of the alternating voltage is a predetermined value, accuracy of linearity of the sum (difference) of the two positional sensors with respect to the change in the position of the rotating shaft 3 is lowered, but it is useful if the vacuum pump 1 can be operated normally.

By the way, the rotor 2 is floated/supported in the air by these radial magnetic bearing 33 and axial magnetic bearing 34, but since the supporting force has a component of the force in proportion to a change in a position of the rotor 2, that is, a component corresponding to an elastic force, the rotor 2 has a natural frequency corresponding to a mass or an inertia moment thereof. The rotor 2 floated in the air has three degrees of freedom in each of axial directions of a three-dimensional orthogonal coordinate whose one coordinate axis (hereinafter, referred to as a "z-axis") matched with the axis of the rotating shaft 3 and three degrees of freedom around each of the axes, that is, six degrees of freedom in total, and five degrees of freedom excluding one degree of freedom around the z-axis whose rotational angle is controlled by the motor 32 receive the supporting forces of the radial magnetic bearing 33 and the axial magnetic bearing 34 and thus, the rotor 2 has the natural frequency according to the supporting forces of the radial magnetic bearing 33 and the axial magnetic bearing 34. Particularly, in two degrees of freedom around two axes (hereinafter, referred to as an "x-axis" and a "y-axis", respectively) orthogonal to the z-axis and orthogonal to each other, a motion equation of the rotor 2 has a term in proportion to a rotation speed around the other axis (hereinafter, referred to as an "interference term") as shown in the following expression (2) expressing a motion equation around the x-axis and the following expression (3) expressing a motion equation around the y-axis. Moreover, a size of this interference term is in proportion to a rotation speed of the rotating shaft 3 rotated by the motor 32.

$$D_x-J\ddot{\theta}_x-C\dot{\theta}_x-G_x\theta_x-J_z\dot{\theta}_z\dot{\theta}_y=0 \tag{2}$$

$$D_y-J\ddot{\theta}_y-C\dot{\theta}_y-G_y\theta_y+J_z\dot{\theta}_z\dot{\theta}_x=0 \tag{3}$$

However, in the above expressions (2) and (3), J denotes an inertia moment around the x-axis or the y-axis of the rotor 2, $J_z$ is an inertia moment around the z-axis of the rotor 2, C denotes a viscosity resistance coefficient around the x-axis or the y-axis, $\theta_x$ is a rotational angle around the x-axis of the rotor 2, $\theta_y$ is a rotational angle around the y-axis of the rotor 2, and $\theta_z$ is a rotational angle around the z-axis of the rotor 2. Moreover, in the above expression (2), $D_x$ denotes a disturbance moment acting around the x-axis, and $G_x$ is a spring constant of a moment around the x-axis generated by the supporting force of the radial magnetic bearing 33 in the x-axis direction. Furthermore, in the above expression (3), $D_y$ is a disturbance moment acting around the y-axis, and $G_y$ is a spring constant of a moment around the y-axis generated by the supporting force of the radial magnetic bearing 33 in the y-axis direction. $D_x$ and $D_y$ are generated by imbalance of the rotor 2, an exhaust load of the vacuum pump 1 or the like. $G_x$ and $G_y$ actually have frequency characteristics according to a control design of the radial magnetic bearing 33. It is to be noted that since the rotor 2 has the rotor main body 20, the rotating shaft 3, and the washer 7 (7*a*, 7*b*, 7*c*) as described above, the inertia moment $J_z$ and the inertia moment J are inertia moments of the rotor main body 20, the rotating shaft 3, and the washer 7 (7*a*, 7*b*, 7*c*) to be exact.

An expression for acquiring a natural frequency in each degree of freedom can be derived from the motion equation of each degree of freedom in usual, but regarding around the x-axis and around the y-axis of the radial magnetic bearing 33, it is difficult to derive an expression for acquiring the natural frequency due to a reason that the respective motion equations have interference terms with respect to each other as described above or the like. Thus, a specific magnetic bearing was designed, and a value of the natural frequency of the specific magnetic bearing was acquired by relying on a trial production experiment and computer simulation using a finite element method in the past.

However, even though the natural frequency can be acquired for each of the specific magnetic bearings with these methods, qualitative analysis on how the natural frequency is changed when a set value is changed or the like cannot be conducted on the natural frequency. Thus, the natural frequency was acquired after a series of designs of a specific magnetic bearing were completed, and if the design was changed due to various reasons, the natural frequency was acquired again after a series of the design changes were completed, and in a case of nonconformity, a work of re-change of the design was needed, which took a large amount of time for the design of the magnetic bearing and the turbo-molecular pump.

In the present disclosure, attention was paid to a fact that the radial magnetic bearing 33 of the vacuum pump 1, which is a turbo-molecular pump, is used in vacuum, and two expressions (4) and (5) expressing natural frequencies $\omega_1$, $\omega_2$ of the rotor 2, which are present in two each around the x-axis and the y-axis were derived from the above-described expressions (2) and (3) by setting the viscosity resistance coefficient C=0. There are two natural frequencies expressed by the expressions (4), (5) on both around the x-axis and around the y-axis.

[Math. 2]

$$\omega_1 = \sqrt{\frac{J(G_x + G_y) + J_z^2\dot{\theta}_z^2 - \sqrt{2J(G_x + G_y)J_z^2\dot{\theta}_z^2 + J_z^4\dot{\theta}_z^4}}{2J^2}} \quad (4)$$

$$\omega_2 = \sqrt{\frac{J(G_x + G_y) + J_z^2\dot{\theta}_z^2 + \sqrt{2J(G_x + G_y)J_z^2\dot{\theta}_z^2 + J_z^4\dot{\theta}_z^4}}{2J^2}} \quad (5)$$

The following expression (1) expresses a ratio $\gamma$ of the inertia moment $J_z$ around the z-axis to the inertia moment J around the x-axis or the y-axis (hereinafter, referred to as an "inertia moment ratio $\gamma$"). In the present disclosure, attention is also paid to a fact that a relationship between the natural frequencies $\omega_1$, $\omega_2$ of the rotor 2 and the rotational frequency of the rotating shaft 3 is different depending on whether the value of the inertia moment $\gamma$ of the rotor 2 expressed by the following expression (1) is equal to 1 or not, and if not, on whether it is larger or smaller than 1.

$$\gamma = J_z/J \quad (1)$$

Figure 5:
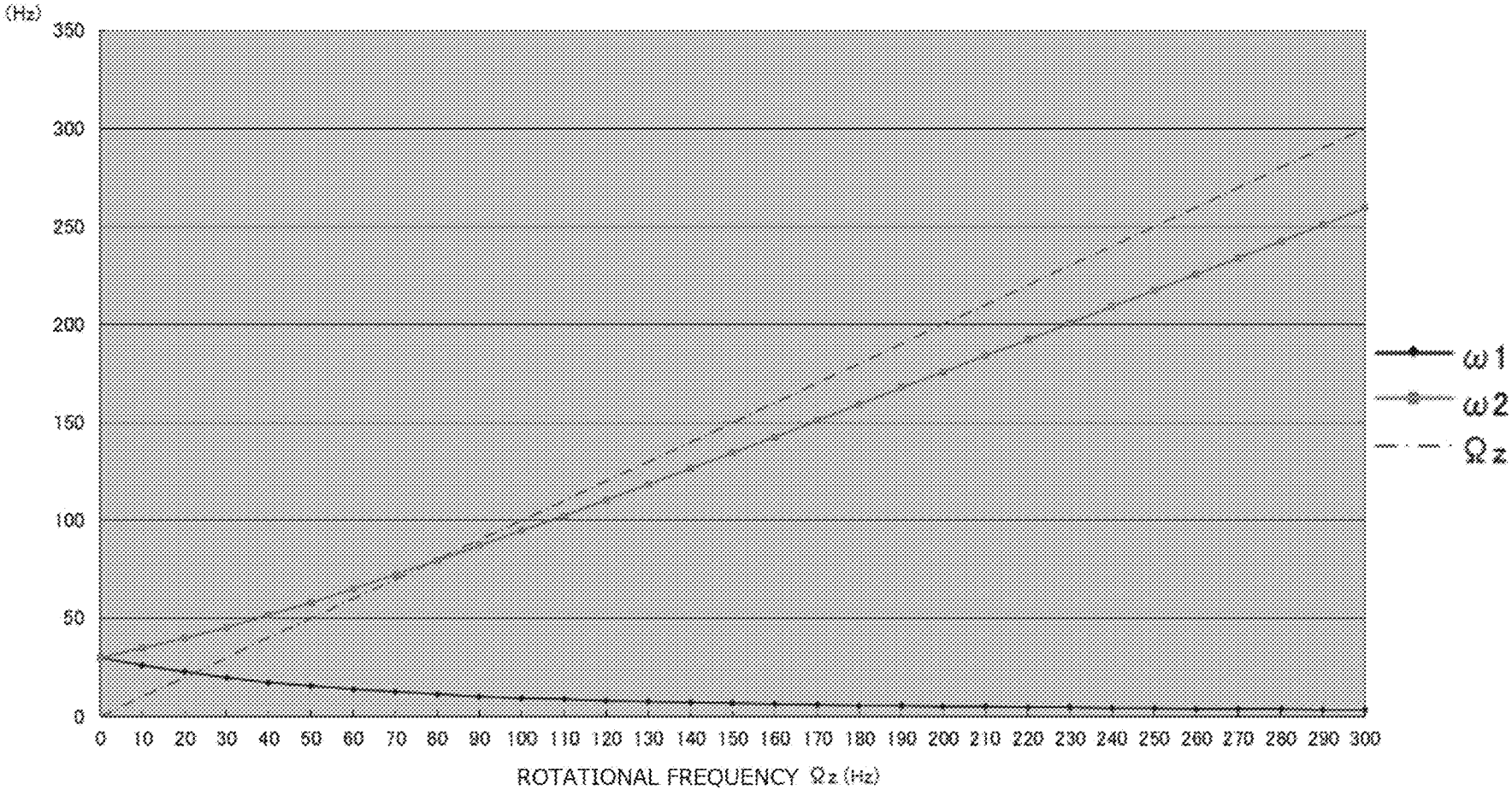
FIG. 5 is a graph illustrating a relationship between a rotational frequency of the rotating shaft and a natural frequency of a rotor when an inertia moment ratio γ of the rotor is smaller than 1.
Figure 6:
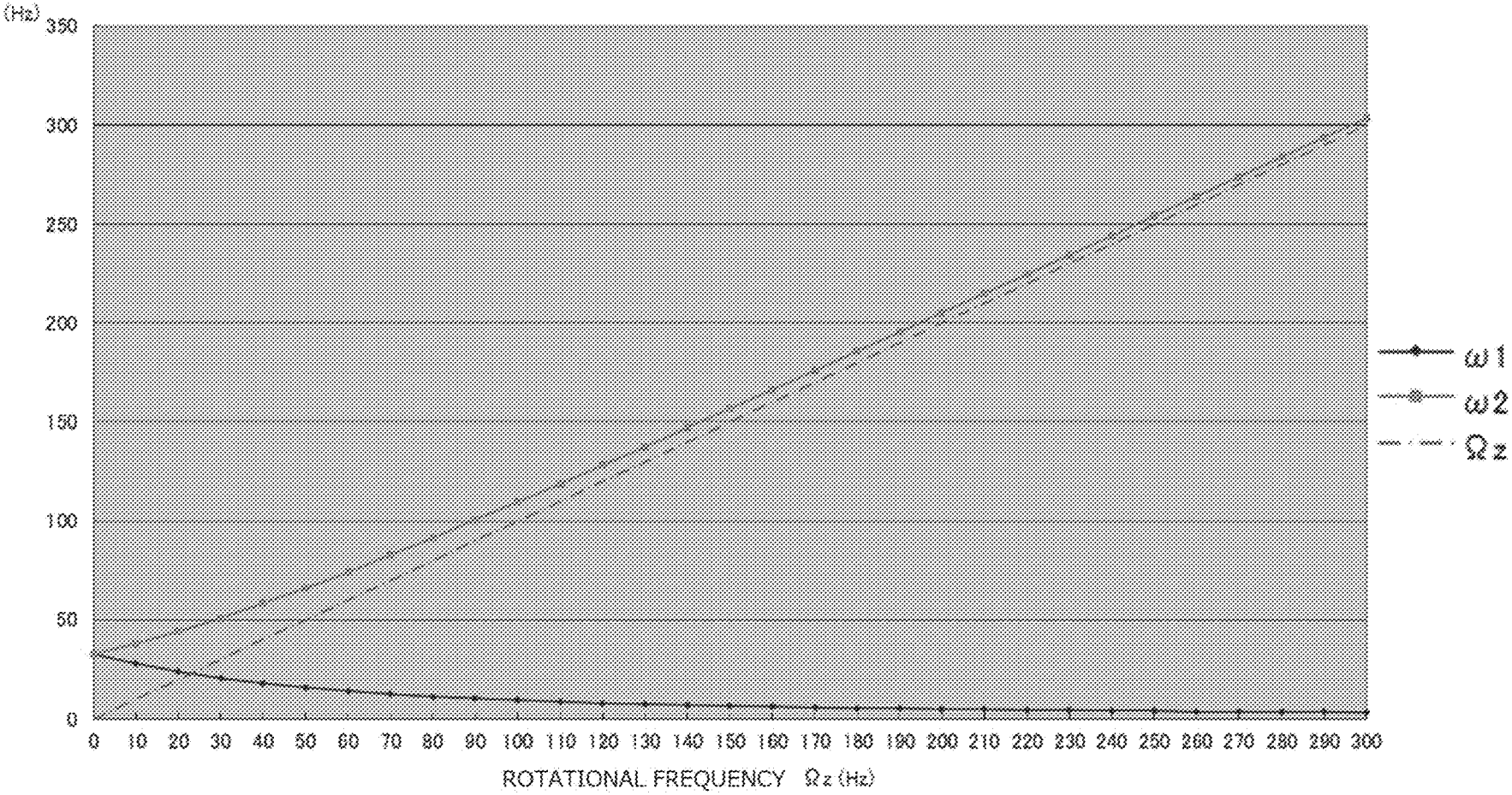
FIG. 6 is a graph illustrating the relationship between the rotational frequency of the rotating shaft and the natural frequency of the rotor when the inertia moment ratio γ of the rotor is equal to 1.
Figure 7:
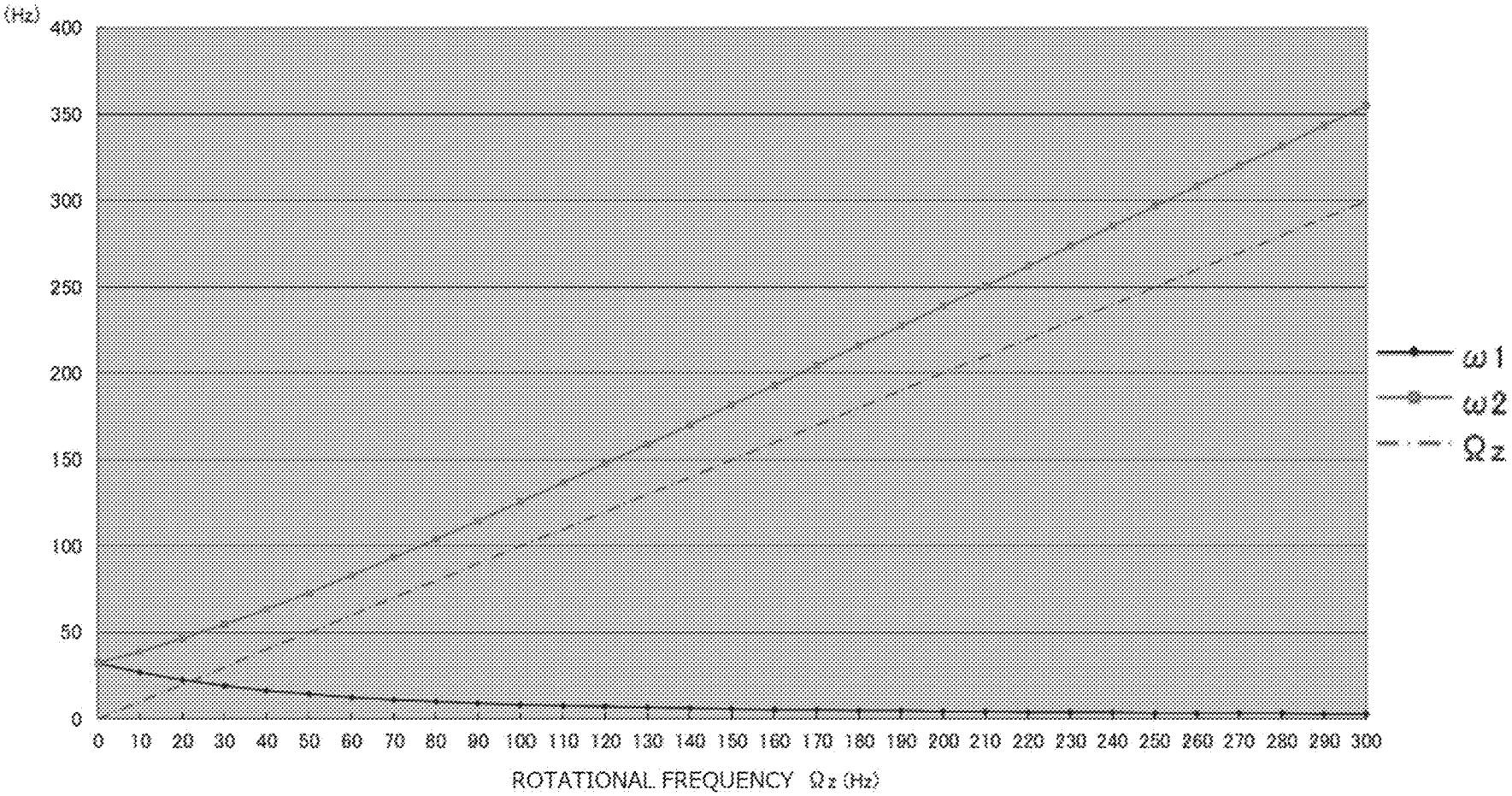
FIG. 7 is a graph illustrating the relationship between the rotational frequency of the rotating shaft and the natural frequency the rotor when the inertia moment ratio γ of the rotor is larger than 1.

First, as shown in FIGS. 5 to 7, the natural frequencies $\omega_1$, $\omega_2$ of the rotor 2 have the same value, regardless of the value of the inertia moment ratio $\gamma$, when the rotating shaft 3 is not rotated, and the rotational frequency $\Omega_z$ is 0. When the rotating shaft 3 starts rotation, and the rotational frequency $\Omega_z$ increases, the natural frequency $\omega_1$ decreases, while the natural frequency $\omega_2$ increases. When the inertia moment ratio $\gamma$ is smaller than 1, as shown in FIG. 5, the natural frequency $\omega_2$ gets closer to the rotational frequency $\Omega_z$ and after matching with the rotational frequency $\Omega_z$, it goes away from the rotational frequency $\Omega_z$. When the inertia moment ratio $\gamma$ is equal to 1, as shown in FIG. 6, a straight line representing the rotational frequency $\Omega_z$ becomes like an asymptotic line, and the natural frequency $\omega_2$ gets closer to the rotational frequency $\Omega_z$. When the inertia moment ratio $\gamma$ is larger than 1, as shown in FIG. 7, it is known that the natural frequency $\omega_2$ does not match the rotational frequency $\Omega_z$ but it goes away.

When the natural frequencies $\omega_1$, $\omega_2$ match the rotational frequency $\Omega_z$ of the rotating shaft 3 or a value close to that, resonance of the rotor 2 is induced, it becomes difficult for the radial magnetic bearing 33 and the axial magnetic bearing 34 to float/support the rotor 2, and continuous vibration of the rotor blade 21 and repeated fluctuation of the stress lead to a fatigue failure. Thus, even if the natural frequencies $\omega_1$, $\omega_2$ temporarily get closer to or match the rotational frequency $\Omega_z$ of the rotating shaft 3, it is desirable that it promptly goes away from the rotational frequency $\Omega_z$ after that.

A rotor of a conventional turbo-molecular pump has a value of the inertia moment ratio $\gamma$ smaller than 1, but in the vacuum pump 1 with exhaustion of a large flowrate of gas which will be required for a semiconductor manufacturing device in the future, for example, the rotor 2 needs to be made larger in a radial direction of the rotating shaft 3. Thus, the inertia moment $J_z$ around the z-axis is increased, and the value of the inertia moment ratio $\gamma$ becomes larger to a value closer to 1, but as the inertia moment ratio $\gamma$ gets closer to 1, the natural frequency $\omega_2$ gets closer to the rotational frequency $\Omega_z$, and particularly when natural frequency $\omega_2$ matches the rotational frequency $\Omega_z$, the rotor 2 vibrates as above and then, the fatigue failure would occur in the rotor blade 21. Therefore, the present disclosure is characterized in that, when the rotor 2 is made larger in the radial direction of the rotating shaft 3, the value of the inertia moment ratio $\gamma$ is set to a value larger than 1.

Next, a method for reducing deflection, vibration of the rotor 2 at steady rotation by adjusting a thickness of the washer 7 so as to adjust a value of the inertia moment ratio $\gamma$ of the rotor 2 increasingly/decreasingly will be described. When the thickness of the washer 7 (7*a*, 7*b*, 7*c*) with the axis of the rotating shaft 3 as a center is adjusted, changed as shown in FIGS. 1A to 1C and FIGS. 2A to 2C, the inertia moment J around the x-axis or the y-axis of the rotor 2 is increased/decreased and thus, the value of the inertia moment ratio $\gamma$ can be adjusted, changed increasingly/decreasingly. Table 1 shows an example of a relationship between the thickness of the washer 7 and the inertia moment ratio $\gamma$. As known from Table 1, by reducing the thickness of the washer 7, the inertia moment ratio $\gamma$ becomes larger, while by increasing the thickness of the washer 7, the inertia moment ratio $\gamma$ becomes smaller.

TABLE 1

| Washer thickness | 5.5 mm | 14 mm | 21 mm | 31 mm | 43 mm |
|---|---|---|---|---|---|
| Inertia moment ratio $\gamma$ | 1.083 | 1.061 | 1.041 | 1.001 | 0.956 |

Figure 8:
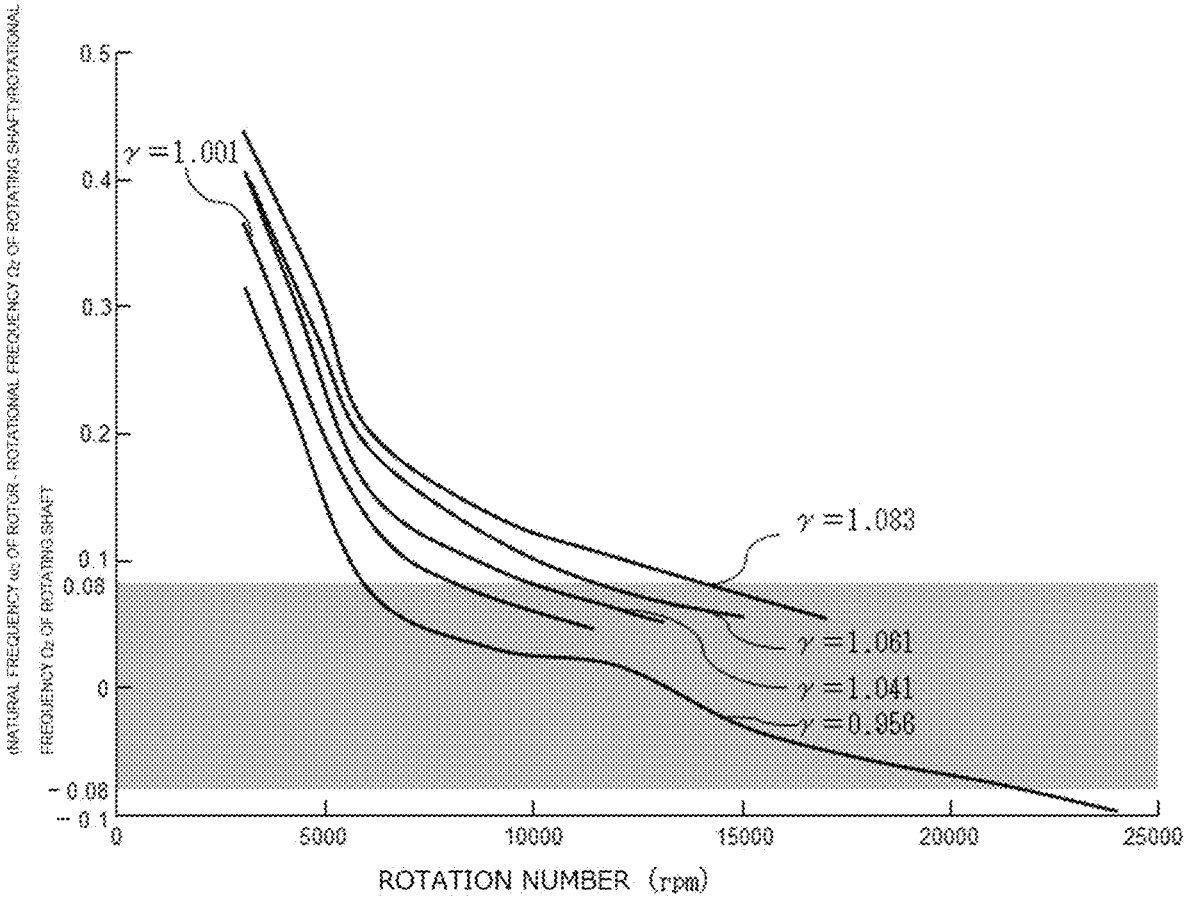
FIG. 8 is a graph illustrating a relationship between a rotation number of the rotating shaft and (the natural frequency of the rotor—the rotational frequency of the rotating shaft)/the rotational frequency of the rotating shaft in each of the inertia moment ratios γ of the rotor.

A relationship between a rotation number of the rotating shaft 3 at each of the inertia moment ratios $\gamma$ of the rotor 2 and (the natural frequency $\omega_2$ of the rotor 2—the rotational frequency $\Omega_z$ of the rotating shaft 3)/the rotational frequency $\Omega_z$ of the rotating shaft 3 is shown in FIG. 8. Assuming that (the natural frequency $\omega_2$ of the rotor 2—the rotational frequency $\Omega_z$ of the rotating shaft 3)/the rotational frequency $\Omega_z$ of the rotating shaft 3 is $\alpha$, a range of $-0.08<\alpha<0.08$, for example, in FIG. 8 corresponds to a range in which deflection of the rotor 2 becomes larger than 80 μm (peak to peak value; the same applies to the following). Since a clearance in the radial direction between the rotating shaft 3 and the protective bearing 31 is often designed to be 50 μm at the minimum over the entire circumference of the rotating shaft 3 and approximately 100 μm for a total of the clearances on both sides with the rotating shaft 3 between them, by setting the deflection of the rotor 2 smaller than 80 μm, contact between the rotating shaft 3 and the protective bearing 31 can be prevented.

In order to set the deflection of the rotor 2 smaller than 80 μm, it is only necessary to make adjustment such that a goes out of the range of $-0.08<\alpha<0.08$ at the rotation number at the steady rotation of the rotor 2 by adjusting the thickness of the washer 7 so as to adjust the value of the inertia moment ratio γ increasingly/decreasingly. Specifically, when the rotor 2 is designed with the washer 7 with the predetermined thickness as a reference, adjustment can be made such that a at the rotation number at the steady rotation of the rotor 2 becomes 0.08 or more by replacement to the washer 7 with a thickness smaller than the predetermined so as to increase the value of the inertia moment ratio γ or such that a at the rotation number at the steady rotation of the rotor 2 becomes −0.08 or less by replacement to the washer 7 with a thickness larger than the predetermined so as to decrease the value of the inertia moment ratio γ.

By preparing some kinds of the washers 7 with different thicknesses in advance, the inertia moment ratio γ can be adjusted by replacement to the washer 7 with a thickness different from the predetermined thickness even after the rotor 2 is designed with the washer 7 with the predetermined thickness as a reference.

As described above, in this example, when the rotor 2 is made larger in the radial direction of the rotating shaft 3, for example, the value of the inertia moment ratio γ of the rotor 2 is set to a value larger than 1 and thus, the natural frequency $\omega_2$ of the rotor 2 can be prevented from getting closer to the rotational frequency $\Omega_z$ of the rotating shaft 3, and vibration of the rotor 2 can be reduced.

Moreover, in this example, by adjusting the thickness of the washer 7 through replacement of the washer 7 which would hardly affect other components even if after replacement or adjustment with the washer 7 with a different thickness or the like, the value of the inertia moment ratio γ of the rotor 2 is adjusted increasingly/decreasingly so that the deflection, vibration of the rotor 2 at the steady rotation can be reduced and thus, works such as balancing of the rotor 2 and the adjustment of the value of γ are facilitated, the number of processes can be reduced, and cost reduction can be realized.

As described above, the present disclosure has been described by citing the examples, but the present disclosure is not limited to each of the above examples but is capable of various variations other than the above-described variations. For example, in the above-described examples, the example in which the thickness of the washer 7 is adjusted in order to reduce the deflection of the rotor 2 smaller than 80 μm was described, but an allowed deflection width of the rotor 2 can be set by changing as appropriate depending on an application, a size, a shape, a type and the like of the vacuum pump.

Moreover, in the present disclosure, it is also possible to adjust the value of the inertia moment ratio γ of the rotor 2 to a value larger than 1 by adjusting the thickness of the washer 7 when the rotor 2 is made larger in the radial direction of the rotating shaft 3, for example.

Furthermore, in the above-described example, the case in which the rotor 2 has the washer 7 was described, but even with the rotor 2 which does not have the washer 7, the value of the inertia moment ratio γ of the rotor 2 can be a value larger than 1, and in this case, the inertia moment $J_z$ and the inertia moment J are inertia moments of the rotor main body 20 and the rotating shaft 3.

Furthermore, in the above-described example, the example in which the vacuum pump 1 is used for the semiconductor manufacturing device was described, but the vacuum pump 1 can be also used similarly for an electron microscope, a surface analyzer, a micromachining device and the like other than that.

What is claimed is:

1. A vacuum pump, comprising:

a casing having an inlet port and an outlet port;

a rotor having a rotating shaft;

a magnetic bearing which rotatably supports the rotating shaft; and a motor which rotates/drives the rotating shaft; and wherein the vacuum pump is configured to transfer a gas taken in through the inlet port to the outlet port by rotation of the rotor, wherein a value of γ expressed in an expression below is larger than 1, and wherein at least one natural frequency of the rotor increases without matching a rotational frequency of the rotating shaft when the rotational frequency of the rotating shaft increases:

$$\gamma = J_z / J$$

wherein, for the above expression, $J_z$ is an inertia moment around an axis of the rotating shaft of the rotor, and J is the inertia moment around an axis orthogonal to the axis of the rotating shaft of the rotor.

2. The vacuum pump according to claim 1, wherein:

the rotor has a plurality of rotor blades formed on an outer peripheral surface; and the vacuum pump is a turbo-molecular pump having a plurality of stator blades provided in the casing and disposed alternately with the rotor blades in an axis direction of the rotating shaft.

3. The vacuum pump according to claim 2, wherein:

the rotor has a cylinder portion with the axis of the rotating shaft as a center on a downstream side to which the gas is transferred from the rotor blade; and the vacuum pump includes a spacer provided in the casing and having a thread groove formed on an inner peripheral surface by opposing the cylinder portion.

4. A rotor used in a vacuum pump including:

a casing having an inlet port and an outlet port;

a magnetic bearing which rotatably supports a rotating shaft; and a motor which rotates/drives the rotating shaft, the motor accommodated in the casing and having the rotating shaft; and wherein the rotor is configured to transfer a gas taken in through the inlet port to the outlet port by rotation, wherein a value of γ expressed in an expression below is larger than 1, and wherein at least one natural frequency of the rotor increases without matching a rotational frequency of the rotating shaft when the rotational frequency of the rotating shaft increases:

$$\gamma = J_z / J$$

wherein for the above expression, $J_z$ is an inertia moment around an axis of the rotating shaft of the rotor, and J is the inertia moment around an axis orthogonal to the axis of the rotating shaft of the rotor.

5. A vacuum pump, comprising:

a casing having an inlet port and an outlet port;

a rotor having a rotating shaft and a disc-shaped washer with an axis of the rotating shaft as a center;

a magnetic bearing which rotatably supports the rotating shaft; and a motor which rotates/drives the rotating shaft; and wherein the vacuum pump is configured to transfer a gas taken in through the inlet port to the outlet port by rotation of the rotor, wherein a value of γ expressed in an expression below can be adjusted by adjusting a thickness of the washer, and wherein at least one natural frequency of the rotor increases without matching a rotational frequency of the rotating shaft when the rotational frequency of the rotating shaft increases:

$$\gamma = J_z / J$$

where in wherein for the above expression, $J_z$ is an inertia moment around an axis of the rotating shaft of the rotor, and J is the inertia moment around an axis orthogonal to the axis of the rotating shaft of the rotor.

6. The vacuum pump according to claim 5, wherein:

with the washer with a predetermined thickness as a reference, deflection of the rotor at steady rotation is decreased by decreasing the value of γ expressed in the above-described expression by increasing a thickness of the washer or by increasing the value of γ expressed in the above-described expression by decreasing the thickness of the washer.

7. The vacuum pump according to claim 6, wherein:

deflection of the rotor at steady rotation is set smaller than 80 μm.

8. The vacuum pump according to claim 5, wherein:

a thickness of the washer is adjusted such that a value of γ expressed in the above-described expression is larger than 1.

* * * * *